US005189761A

United States Patent [19]

Chisholm

[11] Patent Number: 5,189,761

[45] Date of Patent: Mar. 2, 1993

[54] STRAP FOR COLLECTING AND TRANSPORTING RECYCLABLE MILK CONTAINERS AND METHOD OF USING SAME

[76] Inventor: Bruce Chisholm, P.O. Box 25094, Portland, Oreg. 97225

[21] Appl. No.: 863,212

[22] Filed: Apr. 3, 1992

[51] Int. Cl.[5] ..... B65D 63/00

[52] U.S. Cl. ..... 24/16 PB; 24/16 R; 24/17 AP; 224/269

[58] Field of Search ..... 24/16 PB, 16 R, 17 A, 24/17 AP, 30.5 P, 306; 224/269

[56] References Cited

U.S. PATENT DOCUMENTS

| | | | |
|---|---|---|---|
| 1,086,442 | 2/1914 | Cornelius | 24/17 A |
| 2,970,729 | 2/1961 | Allen | 24/30.5 P |
| 2,977,145 | 3/1961 | Rifkin | 24/16 PB |
| 3,022,557 | 2/1962 | Logan | 24/16 PB |
| 3,072,986 | 1/1963 | Lefnaer | 24/16 PB |
| 3,224,054 | 12/1965 | Lige | 24/16 PB |
| 3,973,610 | 8/1976 | Ballin | 24/30.5 P |
| 4,466,159 | 8/1984 | Burage | 24/17 A |
| 4,477,950 | 10/1984 | Cisek et al. | 24/17 AP |
| 4,942,644 | 7/1990 | Rowley | 24/30.5 P |

FOREIGN PATENT DOCUMENTS

| | | | |
|---|---|---|---|
| 0209245 | 5/1960 | Austria | 24/16 PB |
| 1075876 | 10/1954 | France | 24/30.5 P |
| 0027169 | of 1899 | United Kingdom | 24/16 PB |
| 0698696 | 10/1953 | United Kingdom | 24/17 AP |
| 1108514 | 4/1968 | United Kingdom | 24/16 PB |

*Primary Examiner*—Victor N. Sakran

*Attorney, Agent, or Firm*—Chernoff, Vilhauer, McClung & Stenzel

[57] ABSTRACT

A flexible elongate strap for collecting and transporting recyclable milk containers includes opposite ends which can be fastened together, with one of the ends containing an opening, and the medial section of the strap defining a slot. A first milk container is attached to the strap by passing a first end of the strap through the handle of the container and then through the slot to form a loop around the handle. The end of the strap is then passed through the handles of additional containers which are retained on the strap by the first container. The hole in the end of the strap allows the strap and its attached containers to be suspended from a hook for storage. Prior to transporation the ends of the strap are fastened together to secure the containers to the strap.

3 Claims, 2 Drawing Sheets

STRAP FOR COLLECTING AND TRANSPORTING RECYCLABLE MILK CONTAINERS AND METHOD OF USING SAME

BACKGROUND OF THE INVENTION

This invention relates to a method and apparatus for collecting and transporting milk containers for recycling.

World population pressures are increasingly affecting the environment. As more people become aware of the effect their own particular actions have on the environment, individuals are increasingly willing to become environmentally responsible consumers. This responsibility is often expressed through recycling, rather than discarding, such things as old newspapers and used containers. The environmentally aware consumer is particularly conscious of the desirability of recycling plastic because plastic is not generally biodegradable.

Once a decision to recycle has been made, items previously discarded must be suitably prepared and temporarily stored pending recycling. Since storage space is at a premium in most homes, it is often simpler to discard used items rather than recycle them. Plastic milk containers in particular are bulky and difficult to store and transport. If the containers are stored in boxes or bags prior to transportation storage space for the boxes or bags must be found. The consumer is also responsible for delivering recyclable items to a recycling collection point, whether it be curbside for pickup or a remote recycling center. Transporting bulky items such as milk containers also is difficult. More people would be willing to recycle plastic milk containers if these storage and transportation problems could be overcome.

Many recycling aids are available. For example, U.S. Pat. No. 5,079,803 discloses a biodegradable strap for bundling newspapers and other recyclable papers. However, there still exists a need for a more convenient method of storing bulky containers, particularly that type of container which a family may accumulate in large numbers over a fairly short period of time, such as plastic milk containers. Obviously, the greater the level of milk consumption for any given family, the greater the number of used milk containers and the larger the storage and transportation problem.

What is still needed, then, is a convenient method of storing and transporting recyclable milk containers.

SUMMARY OF THE INVENTION

The present invention provides a strap for collecting and transporting milk containers for recycling. The flexible elongate strap includes opposite ends which can be fastened together, with one of the ends containing an additional hole or opening. In addition, the medial section of the strap defines a slot.

In use, a first recyclable milk container is attached to the strap by passing one end of the strap through the handle of the milk container and then through the slot in the strap to form a loop that encircles the container handle. Each additional milk container is placed on the strap by passing the end of the strap through the handle of the milk container. The first-attached container serves as a stop to secure the subsequently added containers on the strap. The hole at the end of the strap allows the strap to be suspended from a hook or a nail for easy out-of-the-way storage of the strap and any attached milk containers. When it is time to transport the containers the ends of the strap can be fastened together to secure all of the containers to the strap. The strap is preferably composed of the same material as the recyclable milk containers that are to be collected and transported.

It is a principal object of the invention to provide a strap for collecting and transporting recyclable milk containers.

It is a further object of the invention to provide a strap to which recyclable milk containers can be easily attached.

It is a still further object of the invention to provide a strap that can be conveniently stored by suspending it with the milk containers attached.

An important feature of the invention is the provision of the fastening closure at the opposite ends of the strap.

It is also an object of the invention to provide a strap for collecting recyclable milk containers that is the same material as the containers.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figures 1, 2, 5:
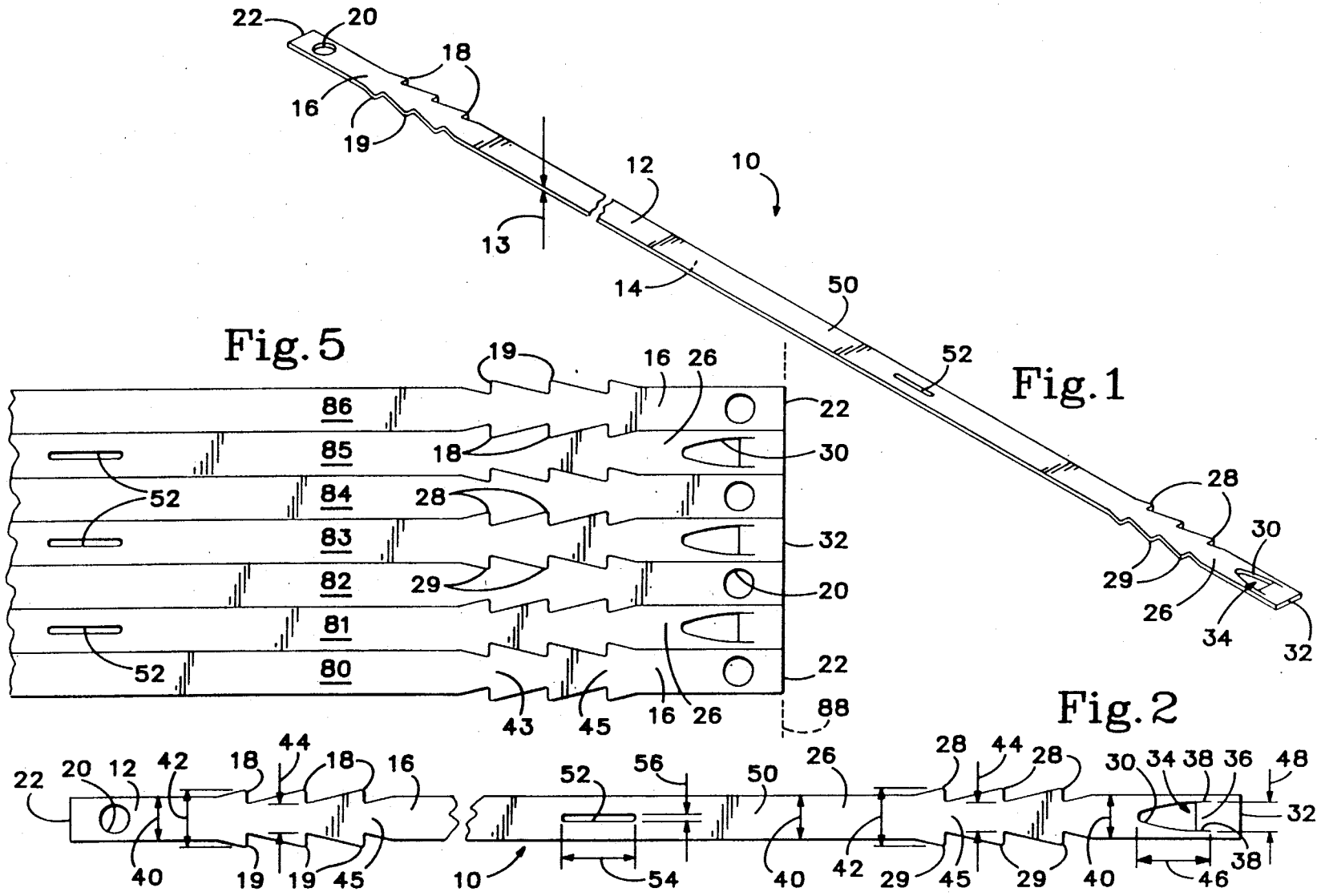
FIG. 1 is a shortened perspective view of a strap for collecting and transporting recyclable milk containers present invention.
FIG. 2 is a shortened plan view, at an enlarged scale, of the strap shown in FIG. 1.
FIG. 5 is a plan view of a sheet containing several of the straps of the present invention.

A strap embodying the present invention is shown in FIGS. 1–4. The strap 10 is generally flat, having opposite sides 12 and 14 which are generally parallel, and a thickness 13 which is large enough to supply the necessary strength. A first end 16 of the strap defines a series of spaced-apart shoulders 18, each shoulder preferably being located opposite another shoulder 19. In addition, an opening 20 is located between the shoulders and the terminus 22 of the strap.

A second end 26 of the strap 10 defines a series of shoulders 2B which also are located opposite other shoulders 29. An opening 30 is located between the shoulders and the terminus 32 of the strap.

The strap generally has a width 40 except in that area defining the shoulders. The strap has a maximum width 42 between each set of opposed shoulders 18 and 19, and 28 and 29, that is larger than the width 40 of the remainder of the strap, and a minimum width 44 at a neck portion 45 of the strap located adjacent each set of opposed shoulders.

The opening 30 defined in the second end of the strap includes a receptacle portion 34 located proximate the terminus 32. The receptacle portion includes a projection 36 defined by two notches 38. The opening 30 has a length 46 that is generally greater than the maximum strap width 42, and a maximum width 48 which is slightly larger than the neck portion. Thus, the first end of the strap can be inserted into the opening, twisted and the neck portion 45 of the first end of the strap pulled into engagement with the receptacle portion 34 of the opening.

The medial section 50 of the strap defines a slot 52 having a length 54 that is generally greater than the maximum width 42 of the strap, and a width 56 that is greater than the thickness 13 of the strap.

Figure 3:
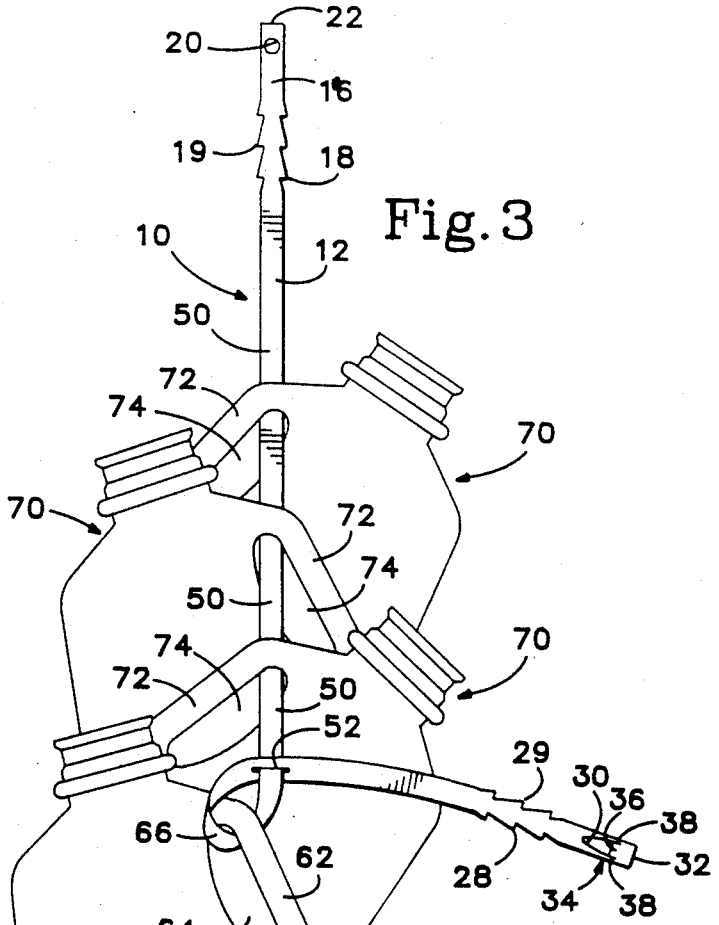
FIG. 3 is a side elevation view of the strap shown in FIG. 1 with milk containers attached.
Figure 4:
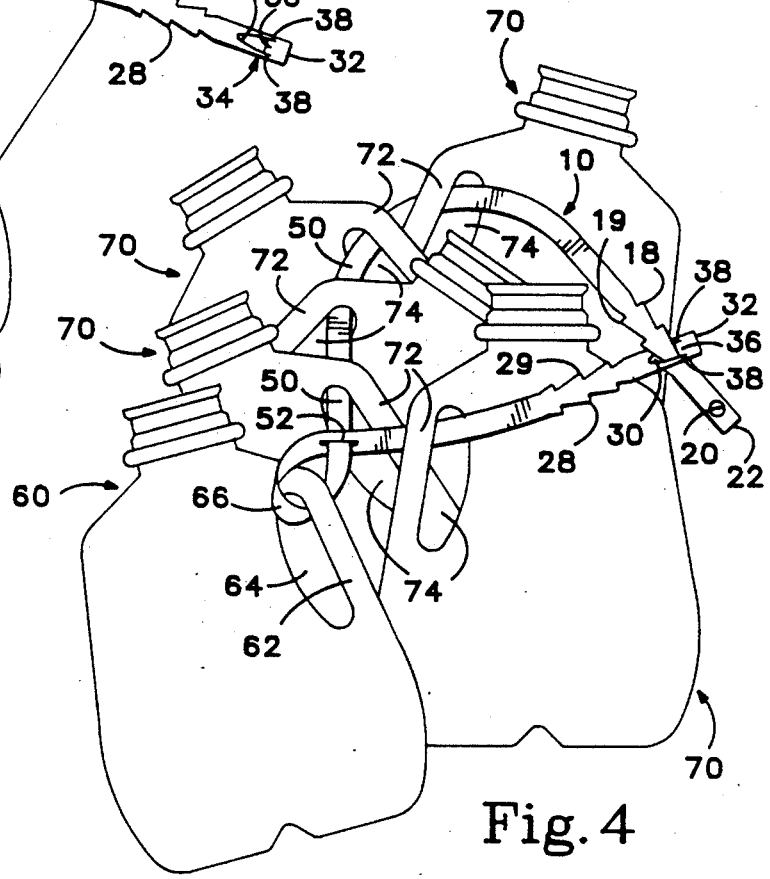
FIG. 4 is a side elevation view of the strap shown in FIG. 3 with attached milk containers: prepared for transporting.

The strap is shown in operation in FIGS. 3 and 4. A first recyclable milk container 60, generally formed of high density polyethylene, has a handle 62 defining an opening 64. The first recyclable container 60 is attached to the medial section of the strap by passing the end of the strap defining the opening 20, first through the opening 64 defined by the handle and then through the slot 52 in the medial section 50 of the strap to form a loop 66 that encircles the handle 62 of the milk container. The first recyclable milk container is thus secured to the strap.

Each additional milk container 70 is then attached to the strap by inserting the end 16 of the strap through the opening 74 in its handle 72. The first attached milk container 60 acts as a stop and retains the additional milk containers on the strap.

The opening 20 in the end of the strap is large enough to fit over a hook or nail (not shown). Thus, the strap and its attached milk containers can be suspended by placing the opening 20 over a conveniently located hook. Additional milk containers can be periodically attached to the strap for convenient storage. It will be appreciated that the circular opening 20 might be of another shape, as long as it is large enough to perform its function.

When it is time to transport the containers, the ends of the strap are fastened together, as shown in FIG. 4. The first end of the strap is passed through the opening 30 in the second end, the receptacle 34 adjustably receiving two opposite shoulders 18 and 19. The neck portion 45 of the first end of the strap is then releasably engaged in the projection 36 of the receptacle. The first end of the strap is thus fastened to the second end of the strap with the attached milk containers secured to the medial section of the strap, permitting easy transport of strap and containers.

The strap. 10 is preferably the same material as the recyclable milk containers to facilitate the actual recycling process. When strap and containers are of the same recyclable material there is no need to separate straps and containers prior to the recycling procedure.

The strap is preferably cut from a sheet of suitable material as shown in FIG. 5. For a plurality of straps 80, 81, 82, 83, 84, 85, 86, a first end 16 of each strap is associated with a second end 26 of each adjacent strap, except for the two boundary straps 80, 86, so that each terminus 22, 32 lies along a straight line 88 and, a shoulder 19 of a first end is adjacent a shoulder 29 of a second end. The shoulders of the opposite ends of the straps 80–86 will be similarly associated, and are not shown.

A single strap is easily removed from association with the adjacent strap for use in collecting and transporting milk containers for recycling.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A method for collecting and transporting recyclable milk containers having handles comprising:

(a) providing an elongate flexible strap including:

(i) a first end having a width and defining one or more shoulders, (ii) a second end defining an opening having a length longer than said width, a portion of said opening including a notch, (iii) a medial section located between said first end and said second end defining a slot that will slidably receive said strap;

(b) inserting said first end of said strap through said handle of a first milk container;

(c) inserting said first end of said strap through said slot of said medial section of said strap to form a loop that encircles said handle and thereby attaching said first milk container immovably to said strap;

(d) inserting said first end of said strap through the handles of additional milk containers; and (e) inserting said first end of said strap through said opening in said second end and engaging said shoulder in said notch thereby attaching all of said milk containers to said strap.

2. The method of claim 1 including the additional steps of:

(a) providing a hole in the first end of said strap;

(b) mounting a hook, that will fit through said hole, on a supporting surface;-and (c) inserting said hole onto said hook to store said strap between placement of milk containers thereon.

3. The method of claim 1 wherein said strap is high-density polyethylene.

* * * * *

UNITED STATES PATENT AND TRADEMARK OFFICE

CERTIFICATE OF CORRECTION

PATENT NO. : 5,189,761

DATED : March 2, 1993

INVENTOR(S) : Bruce Chisholm

It is certified that error appears in the above-identified patent and that said Letters Patent is hereby corrected as shown below:

Abstract Line 13 : delete "transporation" insert --transportation--

Column 2 Line 28 : after milk containers insert --embodying the--

Column 2 Line 52 : after shoulder delete "2B" insert --28--

Signed and Sealed this

Sixteenth Day of November, 1993

*Attest:*

*Attesting Officer*

BRUCE LEHMAN

*Commissioner of Patents and Trademarks*